US011420802B2

(12) United States Patent
Kooc et al.

(10) Patent No.: US 11,420,802 B2
(45) Date of Patent: Aug. 23, 2022

(54) BLANK FOR FORMING AN ARTICLE CARRIER

(71) Applicant: WestRock Packaging Systems, LLC, Atlanta, GA (US)

(72) Inventors: Linh L. Kooc, Richmond, VA (US); Wayne A. Cameron, Midlothian, VA (US); David W. Miller, Rockville, VA (US); Stephen G. Simmons, Chesterfield, VA (US); Casey P. Grey, Richmond, VA (US); Meredith W. Allin, Richmond, VA (US); Bradford J. Walling, Chesterfield, VA (US); Matthew E. Zacherle, Chesterfield, VA (US)

(73) Assignee: WESTROCK PACKAGING SYSTEMS, LLC, Atlanta, GA (US)

( * ) Notice: Subject to any disclaimer, the term of this patent is extended or adjusted under 35 U.S.C. 154(b) by 240 days.

(21) Appl. No.: 16/095,789

(22) PCT Filed: May 2, 2017

(86) PCT No.: PCT/US2017/030486

§ 371 (c)(1),
(2) Date: Oct. 23, 2018

(87) PCT Pub. No.: WO2017/192472

PCT Pub. Date: Nov. 9, 2017

(65) Prior Publication Data

US 2019/0135512 A1 May 9, 2019

Related U.S. Application Data

(60) Provisional application No. 62/393,344, filed on Sep. 12, 2016, provisional application No. 62/330,532, filed on May 2, 2016.

(51) Int. Cl.
*B65D 71/42* (2006.01)
*B65D 71/50* (2006.01)

(52) U.S. Cl.
CPC ..... *B65D 71/504* (2013.01); *B65D 71/42* (2013.01); *B65D 2301/10* (2013.01)

(58) Field of Classification Search
CPC ... B65D 71/504; B65D 71/42; B65D 2301/10
(Continued)

(56) References Cited

U.S. PATENT DOCUMENTS 2,823,062 A 2/1958 Toensmeier
2,929,181 A 3/1960 Poupitch
(Continued)

FOREIGN PATENT DOCUMENTS

AU 2009200835 A1 9/2009
DE 20 2018 106 53 1/2019
(Continued)

*Primary Examiner* — Steven A. Reynolds
(74) *Attorney, Agent, or Firm* — Neil G. Cohen; Brian J. Goldberg

(57) ABSTRACT

A blank (1)0 for forming an article carrier (90) has a main panel (12) which includes at least one article retention structure R1 having an aperture A1 defined in the main panel and one or more tabs formed about a periphery of the aperture in the main panel. The one or more tabs are connected to the main panel such that the tabs yield out of the plane of the main panel when an article is received in the aperture to bear against the article. The main panel includes a paperboard substrate and at least one polymeric layer.

21 Claims, 7 Drawing Sheets

(58) Field of Classification Search
USPC ..... 206/150
See application file for complete search history.

(56) References Cited

U.S. PATENT DOCUMENTS

| | | | | | |
|---|---|---|---|---|---|
| 2,936,070 | A | * | 5/1960 | Poupitch | B65D 71/504 206/150 |
| 3,137,109 | A | | 6/1964 | Rapata | |
| RE25,781 | E | | 5/1965 | Akiereb | |
| 3,317,234 | A | | 5/1967 | Burford | |
| 3,404,912 | A | | 10/1968 | Watts | |
| 3,432,202 | A | | 3/1969 | Ebelhardt | |
| 3,515,272 | A | | 6/1970 | Von Gal | |
| 3,601,253 | A | * | 8/1971 | Poupitch | B65D 71/403 206/153 |
| 3,612,266 | A | | 10/1971 | Graser | |
| 3,627,121 | A | | 12/1971 | Dessy | |
| 3,664,497 | A | | 5/1972 | Mascia | |
| 4,139,094 | A | * | 2/1979 | Berry | B65D 71/50 206/148 |
| 4,190,149 | A | | 2/1980 | Oliff et al. | |
| 4,304,329 | A | * | 12/1981 | Graser | B65D 71/42 206/148 |
| 4,465,180 | A | * | 8/1984 | Klygis | B65D 71/504 206/151 |
| 4,518,081 | A | * | 5/1985 | de Larosiere | B65D 71/50 206/158 |
| 4,592,466 | A | * | 6/1986 | Walters | B65D 71/504 206/150 |
| 4,911,289 | A | | 3/1990 | Bird | |
| 5,103,971 | A | | 4/1992 | Schuster | |
| 5,125,506 | A | | 6/1992 | Galbierz et al. | |
| 5,135,104 | A | * | 8/1992 | Jorba | B65D 71/46 206/151 |
| 5,186,321 | A | | 2/1993 | Fadus | |
| 5,188,225 | A | | 2/1993 | Jorba | |
| 5,209,346 | A | * | 5/1993 | Pratt | B65D 71/504 206/150 |
| 5,255,780 | A | * | 10/1993 | Olsen | B65D 71/504 206/150 |
| 5,320,216 | A | | 6/1994 | Pangborn | |
| 5,323,895 | A | | 6/1994 | Sutherland et al. | |
| 5,415,278 | A | | 5/1995 | Sutherland | |
| 5,474,172 | A | | 12/1995 | Zavatone et al. | |
| 5,485,914 | A | | 1/1996 | Martin | |
| 5,487,464 | A | | 1/1996 | Galbierz et al. | |
| 5,551,556 | A | | 9/1996 | Sutherland | |
| 5,551,566 | A | * | 9/1996 | Sutherland | B65D 71/40 206/427 |
| 5,553,704 | A | | 9/1996 | Gordon et al. | |
| 5,553,705 | A | | 9/1996 | Bakx | |
| 5,573,111 | A | | 11/1996 | Gordon et al. | |
| 5,639,137 | A | * | 6/1997 | Bakx | B65D 71/46 206/158 |
| 5,706,936 | A | | 1/1998 | Bernstein | |
| 5,711,419 | A | * | 1/1998 | Beales | B65D 71/40 206/147 |
| 5,718,330 | A | * | 2/1998 | Auffret | B65D 65/44 206/141 |
| 5,791,463 | A | | 8/1998 | Negelen | |
| 5,791,464 | A | | 8/1998 | Galbierz et al. | |
| 6,039,181 | A | | 3/2000 | Whiteside | |
| 6,168,012 | B1 | | 1/2001 | Galbierz | |
| 6,293,392 | B1 | | 9/2001 | Galbierz | |
| 7,144,635 | B2 | * | 12/2006 | Hawes | B32B 27/08 428/510 |
| 7,377,382 | B2 | * | 5/2008 | Borg | B65D 71/50 206/150 |
| 8,113,968 | B2 | | 2/2012 | Fittler | |
| 8,162,135 | B2 | | 4/2012 | Oliveira | |
| 9,004,344 | B2 | | 4/2015 | Smith | |
| D786,702 | S | | 5/2017 | Borg et al. | |
| 10,293,998 | B2 | | 5/2019 | Borg et al. | |
| 2004/0007480 | A1 | | 1/2004 | Pattee et al. | |
| 2007/0193889 | A1 | | 8/2007 | Olsen et al. | |
| 2007/0202324 | A2 | | 8/2007 | Hawes | |
| 2016/0280436 | A1 | | 9/2016 | Taylor et al. | |
| 2018/0362234 | A1 | | 12/2018 | LHeureux et al. | |
| 2019/0119019 | A1 | * | 4/2019 | Patton | G09F 23/00 |

FOREIGN PATENT DOCUMENTS

| | | | |
|---|---|---|---|
| EP | 0398835 | B1 | 10/1996 |
| EP | 2 067 713 | A1 | 6/2009 |
| ES | 2159235 | | 9/2001 |
| GB | 2287448 | A | 9/1995 |
| WO | WO1997018993 | A1 | 5/1997 |

* cited by examiner

BLANK FOR FORMING AN ARTICLE CARRIER

CROSS-REFERENCE TO RELATED APPLICATIONS

This application is a National Phase application of PCT Application PCT/US2017/030486, filed May 2, 2017, which claims the benefit of U.S. Provisional Patent Application No. 62/330,532, filed May 2, 2016 and U.S. Provisional Patent Application No. 62/393,344, filed Sep. 12, 2016, each of which are incorporated herein by reference in their entirety.

TECHNICAL FIELD

The present invention relates to article carriers and to blanks for forming the same. More specifically, but not exclusively, the invention relates to a carrier of the top-gripping type having one or more apertures for receiving and retaining an article therein.

BACKGROUND

In the field of packaging it is known to provide article carriers or cartons for carrying multiple articles. Carriers are well known in the art and are useful for enabling consumers to transport, store and access a group of articles for consumption. For cost and environmental considerations, such carriers need to be formed from as little material as possible and cause as little wastage in the materials from which they are formed as possible. Further considerations are the strength of the carton and its suitability for holding and transporting large weights of articles. It is desirable that the contents of the carrier are secure within the carrier.

It is well known to provide top gripping article carriers in which an aperture is formed in a panel of the carrier, wherein tabs are struck from said aperture. The tabs are displaced out of the plane of said panel when an article is received in the aperture, wherein said tabs engage the article generally about a flange or lip of the article.

The present invention seeks to provide an improvement in the field of article carriers, typically formed from paperboard or the like.

SUMMARY

According to a first aspect of the present disclosure there is provided a blank for forming an article carrier. The blank comprises a main panel which comprises at least one article retention structure having an aperture defined in the main panel. The blank further comprises one or more tabs formed about a periphery of the aperture in the main panel. The one or more tabs is connected to the main panel such that the tabs yield out of the plane of the main panel when an article is received in the aperture so as to bear against the article. The main panel comprises a paperboard substrate and at least one polymeric layer.

Optionally, the paperboard substrate is formed from foldable sheet material selected from the group consisting of paperboard, corrugated board, cardboard and combinations thereof.

Optionally, the at least one polymeric layer comprises an n-axially oriented film wherein "n" is a positive integer.

Optionally, the n-axially oriented film is formed from material selected from the group consisting of a bi-axially oriented polyester, oriented nylon, cross-laminated polyolefin, metallocene-catalysed polyethylene and high density polyolefin.

Optionally, the at least one polymeric layer is tear resistant due to the chemical nature of the material from which it is formed.

Optionally, the material is extruded metallocene-catalysed polyethylene.

Optionally, the main panel is defined by a perimeter to which no other part of the carrier is connected.

Optionally, the main panel is defined by a perimeter including convexly curved edges and concavely curved edges wherein the radius of curvature of the convexly curved edges is substantially equal to the radius of curvature of the concavely curved edges.

Optionally, the carrier is arranged to package articles having a maximum diameter D1 in an array having a first integer number of rows Y, and wherein the main panel has a maximum length equal to or less than Y×D1 when the main panel is applied to articles.

Optionally, the array has a second integer number of columns Z, and wherein the main panel has a maximum width equal to or less than Z×D1 when the engaging panel is applied to articles.

Optionally, the main panel has opposite surfaces having different characteristics to the other surface.

Optionally, one of the opposite surfaces has a surface treatment to provide good printability.

Optionally, the polymeric layer is provided on the other surface of the main panel.

Optionally, the polymeric layer is a tear resistant layer laminated with the paperboard substrate.

Optionally, the main panel comprises a handle structure.

Optionally, the handle structure comprises at least one handle aperture formed in the main panel at location spaced from the aperture.

According to a second aspect of the present disclosure there is provided a blank for forming an article carrier, the blank comprising a main panel which comprises at least one article retention structure having an aperture defined in the main panel, the main panel further comprising one or more tabs formed about a periphery of the aperture in the main panel, the one or more tabs being connected to the main panel such that the tabs yield out of the plane of the main panel when an article is received in the aperture so as to bear against the article, wherein the one or more tabs comprise a paperboard substrate and at least one polymeric layer secured to the substrate.

According to a third aspect of the present disclosure there is provided a blank for forming an article carrier, the blank comprising a main panel which comprises at least one article retention structure having an aperture defined in the main panel, the main panel further comprising one or more tabs formed about a periphery of the aperture in the main panel, the one or more tabs being connected to the main panel such that the tabs yield out of the plane of the main panel when an article is received in the aperture so as to bear against the article, wherein the main panel comprises a paperboard substrate, wherein the carrier is arranged to package articles having a maximum diameter D1 in an array having a first integer number of rows Y, and wherein the main panel has a maximum length equal to or less than Y×D1 when the main panel is applied to articles.

Optionally, the array has a second integer number of columns Z, and wherein the main panel has a maximum width equal to or less than Z×D1 when the engaging panel is applied to articles.

According to a fourth aspect of the present disclosure there is provided a combination comprising two or more connected blanks each for forming an article carrier, each of the blanks comprising a main panel which comprises at least one article retention structure having an aperture defined in the main panel, wherein each of the main panels is defined by a perimeter including convexly curved edges and concavely curved edges, and wherein the two or more connected blanks are connected together at their convexly curved edges.

Optionally, each of the two or more connected blanks is frangibly connected to a next adjacent one of the two or more connected blanks by at least one frangible connection.

Optionally, the radius of curvature of the convexly curved edges is substantially equal to the radius of curvature of the concavely curved edges.

According to a fifth aspect of the present disclosure there is provided a top engaging carrier for packaging one or more articles. The carrier comprises a main panel, which comprises first and second adjacent apertures arranged side by side each for receiving a portion of an article. The main panel further comprises an annular series of tabs formed around each of the first and second apertures. The tabs of each annular series are hingedly connected to the main panel such that the tabs yield out of the plane of the main panel when an article is received in the respective aperture so as to bear against the article, wherein the tabs of each annular series are spaced apart from one another by a cutout placed between each tab and a next adjacent tab. Each cutout comprises a curved end at a location furthermost from the center of the respective aperture. Each of the annular series of tabs defines a respective notional circle, the notional circles being internally and tangentially contacted by the curved ends of the cutouts disposed therein. The notional circles of the two annular series of tabs are spaced apart from each other at a first distance, the distance between the curved end of any one of the cutouts of the first aperture and the curved end of any one of the cutouts of the second aperture being greater than the first distance.

Optionally, none of the tabs have a radial size greater than the radius of the respective notional circle.

Optionally, all of the tabs have a radial size less than the radius of the respective notional circle.

Optionally, the main panel is defined by a perimeter to which no other part of the carrier is connected.

Optionally, the main panel is defined by a perimeter which is free of connection to other panels.

Optionally, the main panel is defined by a perimeter which is defined in its entirety by cut edges.

Optionally, the main panel is defined by a perimeter including convexly curved edges and concavely curved edges wherein the radius of curvature of the convexly curved edges is substantially equal to the radius of curvature of the concavely curved edges.

Optionally, each tab is hinged to the main panel by a straight fold line which is in tangential contact, or intersects, with the curved ends of the adjacent cutout.

Optionally, the diameter of the notional circle is less than the maximum diameter of an article and greater than the diameter of the upper end of the article.

Optionally, the upper end of the article is defined by a feature selected from the following; a chime, a cap or a flange.

Optionally, each tab is hinged to the main panel by a straight fold line which is in tangential contact, or intersects, with the curved ends of the adjacent cutout.

Optionally, the diameter of the notional circle is less than the maximum diameter of an article and greater than the diameter of the upper end of the article.

Optionally, the upper end of the article is defined by a feature selected from the following; a chime, a cap or a flange.

Optionally, the carrier is arranged to package articles having a maximum diameter D1 in an array having a first integer number of rows Y and a second integer number of columns Z.

Optionally, the main panel has a maximum length equal to or less than Y×D1 when the main panel is applied to articles.

Optionally, the main panel has a maximum width equal to or less than Z×D1 when the engaging panel is applied to articles.

Optionally, the curved end of each cutout comprises a radius of curvature equal to or more than 1/16" (1.6 mm).

According to a sixth aspect of the present disclosure there is provided a blank for forming an article carrier. The blank comprises a main panel, which comprises first and second adjacent apertures arranged side by side each for receiving a portion of an article. The main panel further comprises an annular series of tabs formed around each of the first and second apertures. The tabs of each annular series are hingedly connected to the main panel so as to be yieldable out of the plane of the main panel when an article is received in the respective aperture, and configured to bear against the received article. The tabs of each annular series are spaced apart from one another by a cutout placed between each tab and a next adjacent tab; each cutout comprises a curved end at a location furthermost from the center of the respective aperture. Each of the annular series of tabs defines a respective notional circle, the notional circles being internally and tangentially contacted by the curved ends of the cutouts disposed therein. The notional circles of the two annular series of tabs are spaced apart from each other at a first distance. The distance between the curved end of any one of the cutouts of the first aperture and the curved end of any one of the cutouts of the second aperture is greater than the first distance.

According to a seventh aspect of the present disclosure there is provided a carrier for packaging one or more articles comprising a main panel, which comprises at least one article retention structure having an aperture defined in the main panel. The main panel further comprises an annular series of tabs formed around the aperture, the tabs of the annular series being hingedly connected to the main panel such that the tabs yield out of the plane of the main panel when an article is received in the aperture so as to bear against the article. The tabs of the annular series are spaced apart from one another by a cutout placed between each tab and a next adjacent tab, each cutout being defined by a pair of opposing side edges and by a curved end edge extending between the side edges. The curved end is disposed at a location furthermost from the center of the respective aperture, wherein the opposing side edges are divergently arranged with respect to each other.

Optionally, each of the annular series of tabs defines a notional circle. The notional circle is internally and tangentially contacted by the curved ends of the cutouts disposed therein. The hinged connections of the annular series of tabs define a notional polygon having an integer number of sides N; and the opposing side edges of the cutout define an angle θ therebetween, the angle θ being greater than zero degrees and less than a maximum angle $\theta_m$, wherein $$\theta_{max} = 2\left(\frac{180(N-2)}{2N} - \arctan\left(\frac{x}{\frac{Dn}{2}\sin\left(\frac{360}{2N}\right)}\right)\right).$$

Optionally, each of the annular series of tabs defines a notional circle. The notional circle is internally and tangentially contacted by the curved ends of the cutouts disposed therein, wherein the opposing side edges define an angle θ therebetween, wherein the angle θ is within one of the ranges selected from the following group of ranges: angle θ is greater than 0° and less than 45°; angle θ is greater than 0° and less than 30°; angle θ is between 5° and 25°; angle θ is between 10° and 20°; angle θ is between 14° and 17°; angle θ is between 15° and 16°.

Optionally, each of the annular series of tabs defines a notional circle, the notional circle being internally and tangentially contacted by the curved ends of the cutouts disposed therein and wherein the opposing side edges define an angle θ therebetween, wherein the angle θ is approximately 15.5°.

Optionally, each of the annular series of tabs defines a notional circle, the notional circle being internally and tangentially contacted by the curved ends of the cutouts disposed therein. The hinged connections of the annular series of tabs define a notional polygon having an integer number of sides N and wherein the opposing side edges of the cutout define an angle θ therebetween, the angle θ being greater than zero degrees and less than a maximum angle $\theta_m$, wherein $\theta_m$=(180(N−2))/2N.

According to an eighth aspect of the present disclosure there is provided a blank for forming a carrier. The blank comprises a main panel which comprises at least one article retention structure having an aperture defined in the main panel. The main panel further comprises an annular series of tabs formed around the aperture, the tabs of the annular series being hingedly connected to the main panel so as to be yieldable out of the plane of the main panel when an article is received in the aperture and configured so as to bear against the article. The tabs of the annular series are spaced apart from one another by a cutout placed between each tab and a next adjacent tab, each cutout being defined by a pair of opposing side edges and by a curved end edge extending between the side edges. The curved end is disposed at a location furthermost from the center of the respective aperture, wherein the opposing side edges are divergently arranged with respect to each other.

According to a ninth aspect of the present disclosure there is provided a blank for forming an article carrier, the blank comprising a main panel which comprises at least one article retention structure having an aperture defined in the main panel. The blank further comprises an annular series of tabs formed around the aperture in the main panel. The tabs of the annular series are hingedly connected to the main panel such that the tabs yield out of the plane of the main panel when an article is received in the aperture so as to bear against the article. The tabs of the annular series are spaced apart from one another by a cutout placed between each tab and a next adjacent tab. Each cutout comprises a curved end at a location furthermost from a center of the aperture. The main panel comprises a paperboard substrate and at least one polymeric tear resistant layer laminated together.

Optionally, the paperboard substrate may be formed from foldable sheet material selected from the group consisting of paperboard, corrugated board, cardboard and combinations thereof.

Optionally, the at least one polymeric tear resistant layer comprises an n-axially oriented film wherein "n" is a positive integer.

According to a tenth aspect of the present disclosure there is provided a blank for forming an article carrier, the blank comprising a main panel which comprises at least one article retention structure having an aperture defined in the main panel, the blank further comprising a plurality of tabs formed about a periphery of the aperture in the main panel, the plurality of tabs being connected to the main panel such that the tabs yield out of the plane of the main panel when an article is received in the aperture so as to bear against the article, wherein the main panel comprises a paperboard substrate and at least one polymeric layer.

Optionally, the plurality of tabs is formed as an annular series about a periphery of the aperture in the main panel.

According to an eleventh aspect of the present disclosure there is provided a blank comprising a two or more main panels each for forming an article carrier, each of the main panels comprises at least one article retention structure having an aperture defined in therein, wherein each of the main panels is defined by a perimeter including convexly curved edges and concavely curved edges, and wherein the main panels are frangibly connected together such that the blank is applicable to a plurality of groups of articles simultaneously.

Optionally, the blank is attachable as a single unit to a grouped arrangement of articles, the grouped arrangement of articles comprising a two or more groups of articles.

Optionally, the main panels each comprise a matrix or array of article retention apertures, in a Y×Z arrangement, where Y indicates the number of rows of articles and Z indicates the number of columns of articles.

Optionally, the width of the main panels is equal to Z times the maximum width of an article.

Optionally, the length of the main panels is equal to Y times the maximum width of an article.

Within the scope of this application it is envisaged and intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
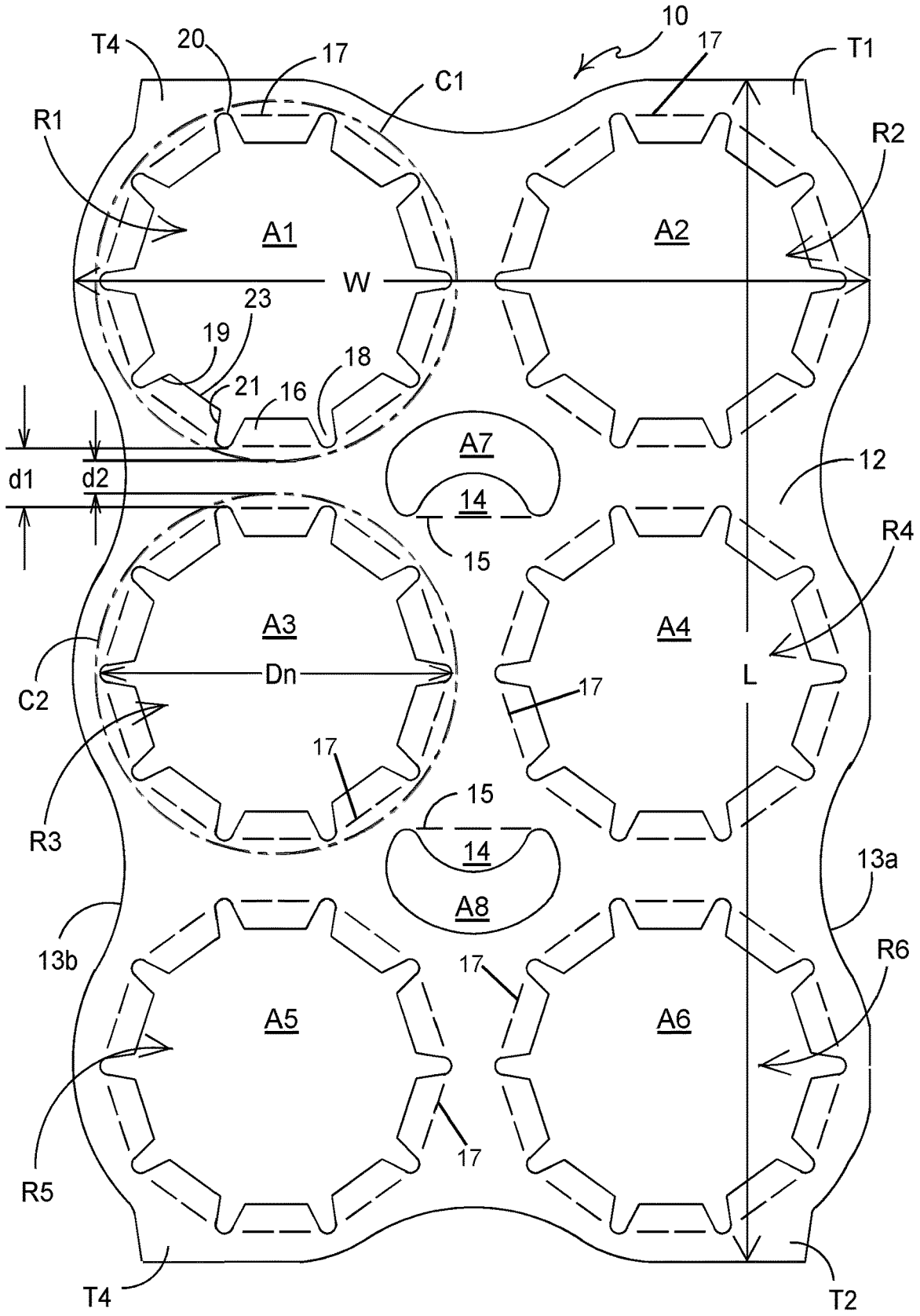
FIG. 1 is a plan view from above of a blank for forming an article carrier according to a first embodiment.
Figure 5:
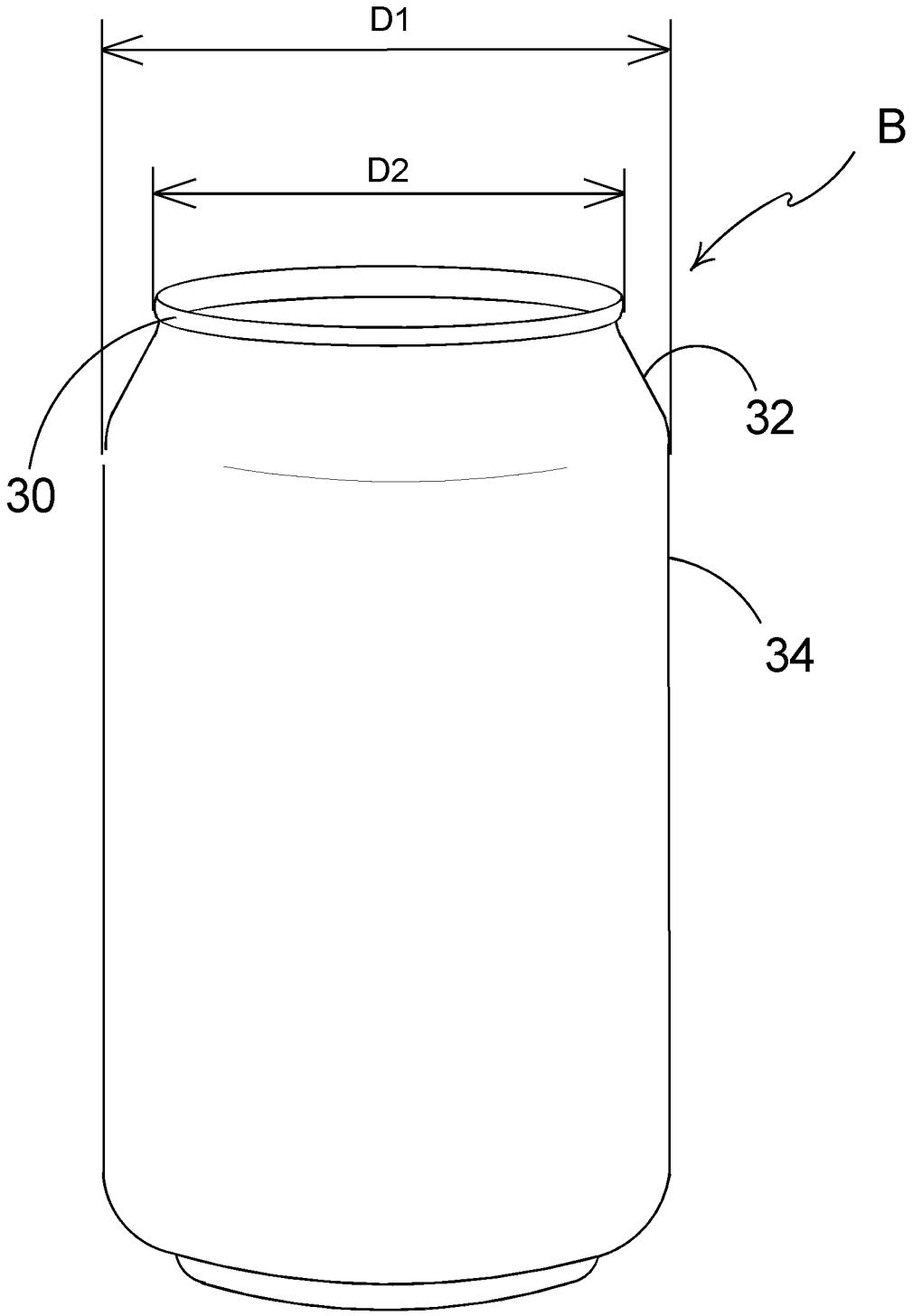
FIG. 5 is a perspective view of an article to be packaged.
Figure 6:
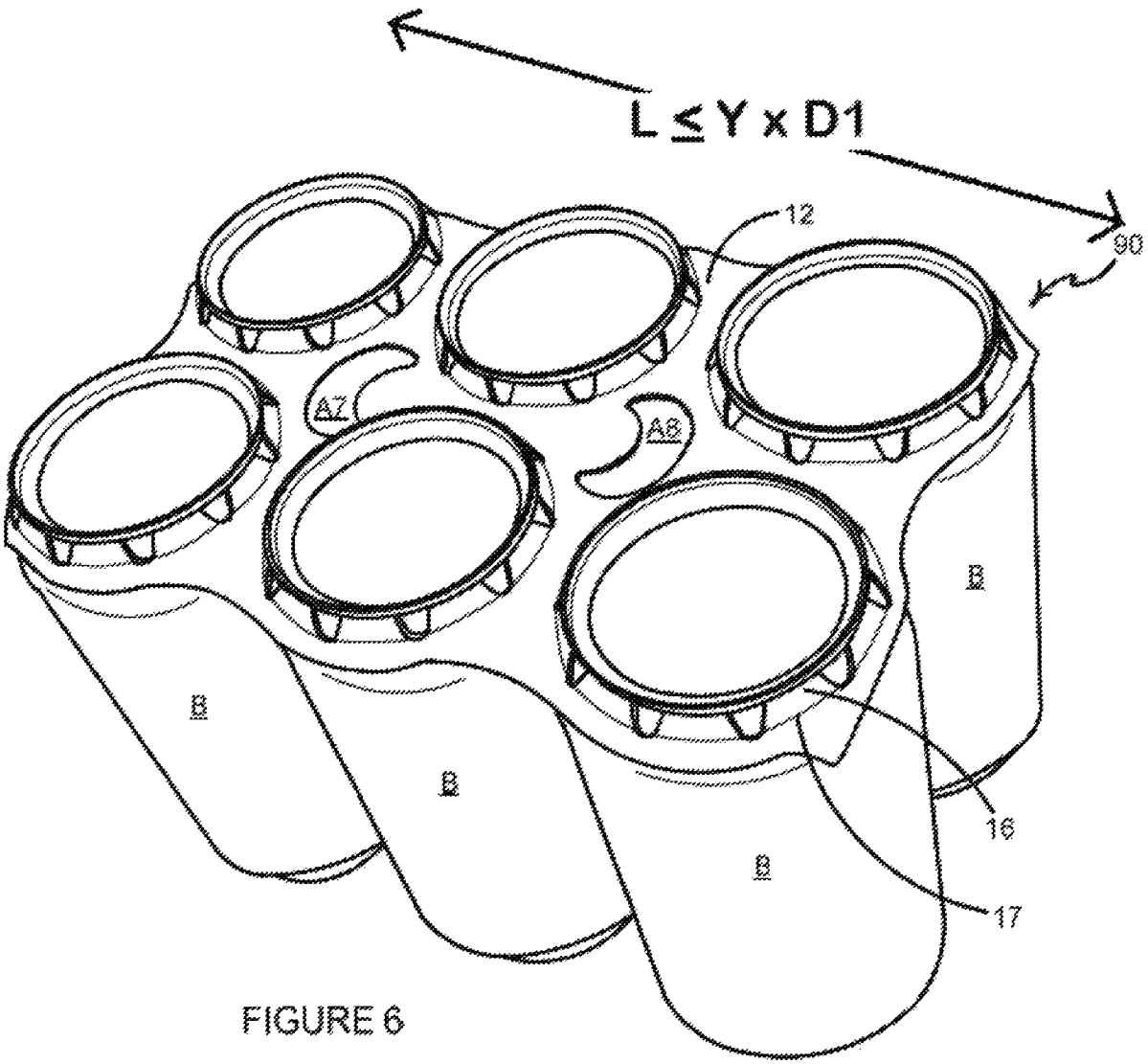
FIG. 6 is a perspective view from above of an article carrier formed from the blank of FIG. 1.
Figure 7:
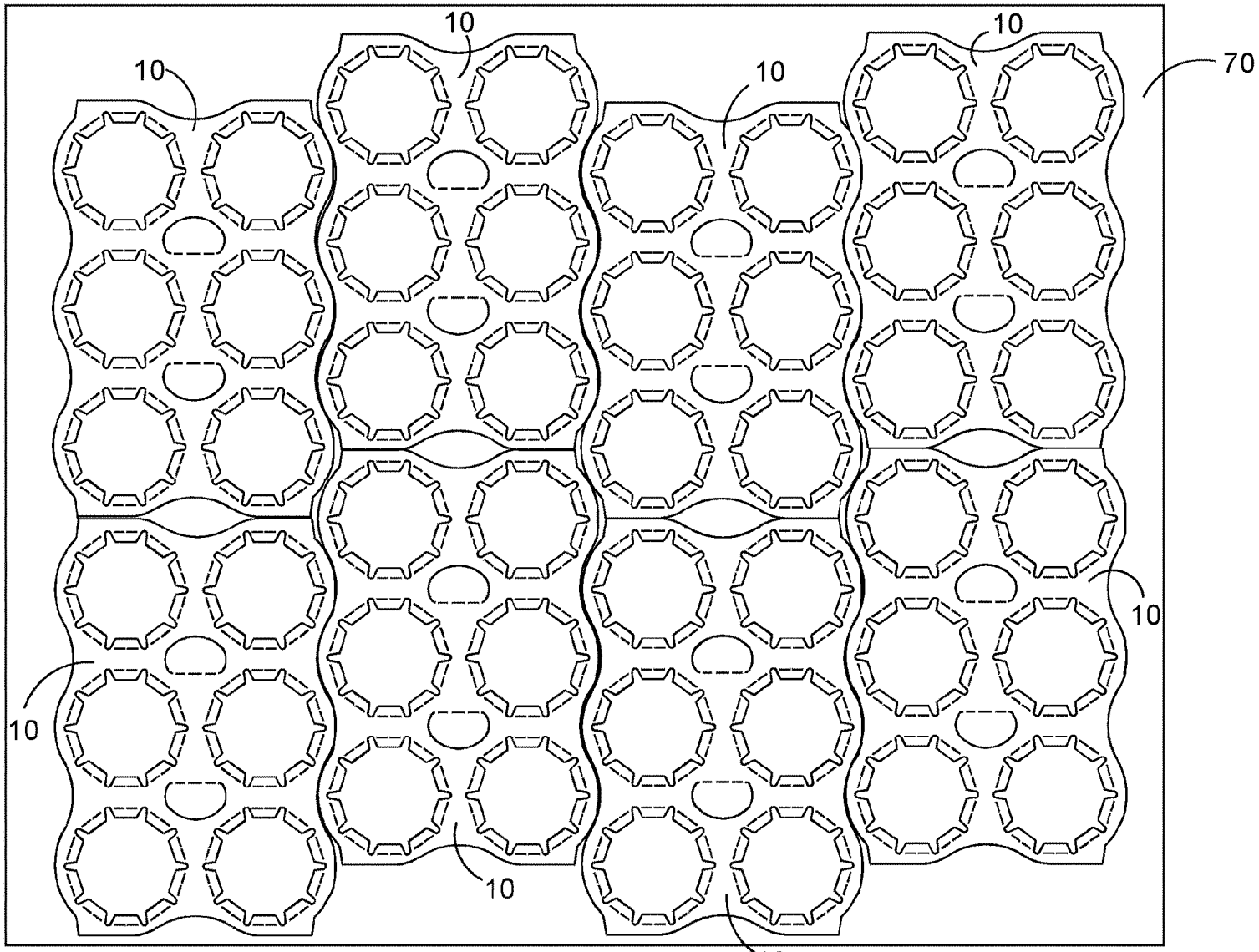
FIG. 7 is a plan view from above of a plurality of blanks according to the first embodiment showing a nesting arrangement for cutting the blanks from a substrate sheet.

Referring to FIG. 1, there is shown a plan view of a blank 10 capable of forming a carton or carrier 90, as shown in FIG. 6, for containing and carrying a group of primary products such as, but not limited to, bottles or cans, hereinafter referred to as articles B, as shown in FIG. 5. The blank 10 forms a secondary package for packaging at least one primary product container or package.

Figure 4:
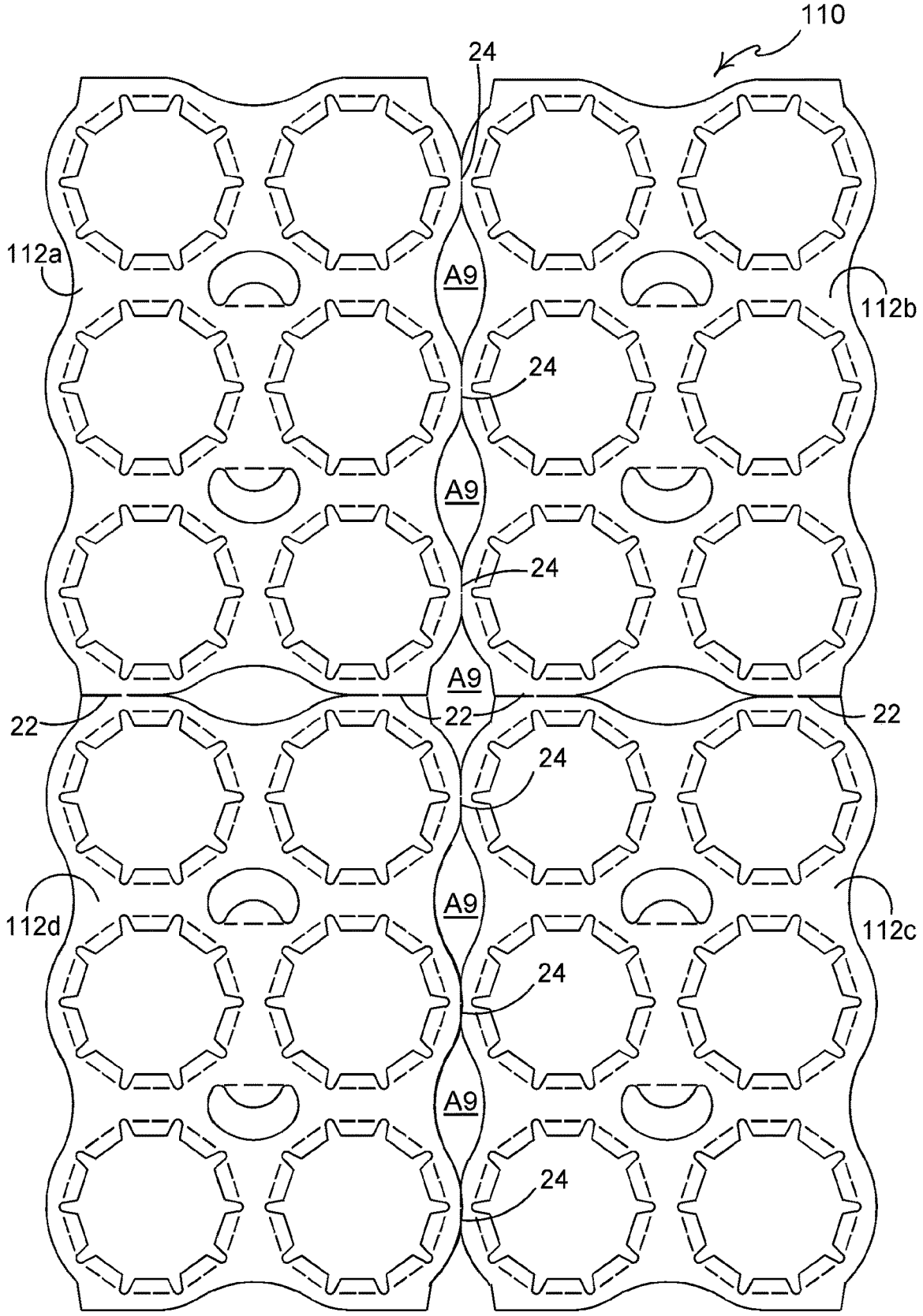
FIG. 4 is a plan view from above of a blank for forming an article carrier according to a second embodiment.

Referring to FIG. 4, there is shown a plan view of a blank 110 capable of forming a carton or carrier, for containing and carrying a group of primary products such as, but not limited to, bottles or cans, hereinafter referred to as articles B (as shown in FIG. 5). The blank 110 forms a secondary package for packaging at least one primary product container or package.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blanks 10,110 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

The packaging structures or carriers described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating, such as a clay coating, or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiment, the blanks 10,110 are configured to form a carton or carrier 90 for packaging an exemplary arrangement of exemplary articles B. In the embodiment illustrated in FIG. 1, the arrangement is a 3×2 matrix or array; in the illustrated embodiment three rows of two articles are provided, and the articles B are beverage cans. In the embodiment illustrated in FIG. 4, the arrangement is a 6×4 matrix or array; in the illustrated embodiment six rows of four articles are provided, and the articles B are beverage cans. In this illustrated embodiment, the blank 110 may employ four blanks 10 in a 2×2 matrix or array, each being frangibly connected to at least two other blanks 10. Alternatively, the blanks 10, 110 can be configured to form a carrier for packaging other types, number and size of articles and/or for packaging articles in a different arrangement or configuration.

Referring to FIG. 1, the blank 10 comprises a main panel 12 for forming a top wall or engaging panel of a carrier 90 (see FIG. 6).

The main panel 12 includes at least one article retention structure R1, R2, R3, R4, R5, R6. In the embodiment of FIG. 1 the main panel comprises a plurality of article retention structures R1, R2, R3, R4, R5, R6, specifically six article retention structures R1, R2, R3, R4, R5, R6 arranged in 2×3 matrix or array.

Each of the article retention structures R1, R2, R3, R4, R5, R6 are substantially similar in construction and will therefore be described in detail with reference to the first and fifth article retention structures R1, R5.

The first article retention structure R1 comprises an aperture A1. A plurality of article engaging tabs 16 are arranged about the periphery of the aperture A1. Each tab 16 is hinged to the main panel 12 by a hinged connection such as a fold line 17. Each tab 16 is spaced apart from its adjacent neighbours by a cutaway or recess 18. In this way each tab 16 comprises a first side edge 19 and a second side edge 21. Each tab 16 comprises a free end edge 23 opposing the hinged end edge 17. The free end edges 23 form engaging edges for retaining an article B, or at least a portion thereof, within the aperture A1. Each of the free end edges 23 may be straight as illustrated FIGS. 1, 2, 4 and 7. However, each end edge 23 may optionally be curved either convexly or concavely as viewed from the center of the respective aperture A1, A2, A3, A4, A5 or A6.

Each of the recesses 18 comprises a curvilinear portion 20. In the illustrated embodiment the recesses 18 comprise a rounded end. That is to say the curvilinear portion 20 can be defined by a portion of the circumference of a circle. A portion of the recess 18 may be defined by a segment of a circle. A further portion of the recess 18 may be defined by a trapezoid; the trapezoid may be an isosceles trapezoid. The trapezoid has convergent side edges 19, 21. Each tab 16 may be hinged to the main panel 12 by the straight fold line 17 which is in tangential contact, or intersects, with the rounded end 20 of the adjacent recess 18.

The curvilinear portion 20 or rounded end of the cutaway 18 may reduce the likelihood of tears propagating in the main panel 12 from the cutaway 18.

In the illustrated embodiment the first article retention structure R1 comprises ten tabs 16 arranged about the periphery of the aperture A1. The article retention structure R1 defines a notional circle C1. The circle C1 is defined by the vertices of a first polygon P1, see FIG. 3. Polygon P1 is defined by the fold lines 17 of the tabs 16, see FIG. 3. In the illustrated embodiment the first polygon P1 is a decagon, or ten sided polygon; in other embodiments, other polygons having more or less sides may be employed. Each of the sides of the first polygon P1 is of equal length.

The notional circle C1 has a diameter Dn and a radius Dn/2.

The free end edges 23 of the tabs 16 define a second polygon P2. The tabs 16 have a height x defined between the free end edge 23 and the hinged edge 17. In the illustrated embodiment the first polygon P1 is a decagon, or ten sided polygon; in other embodiments other polygons having more or less sides may be employed. The second polygon P2 comprises the same number of sides as the first polygon P1. Each of the sides of the second polygon P2 is of equal length.

Figure 2:
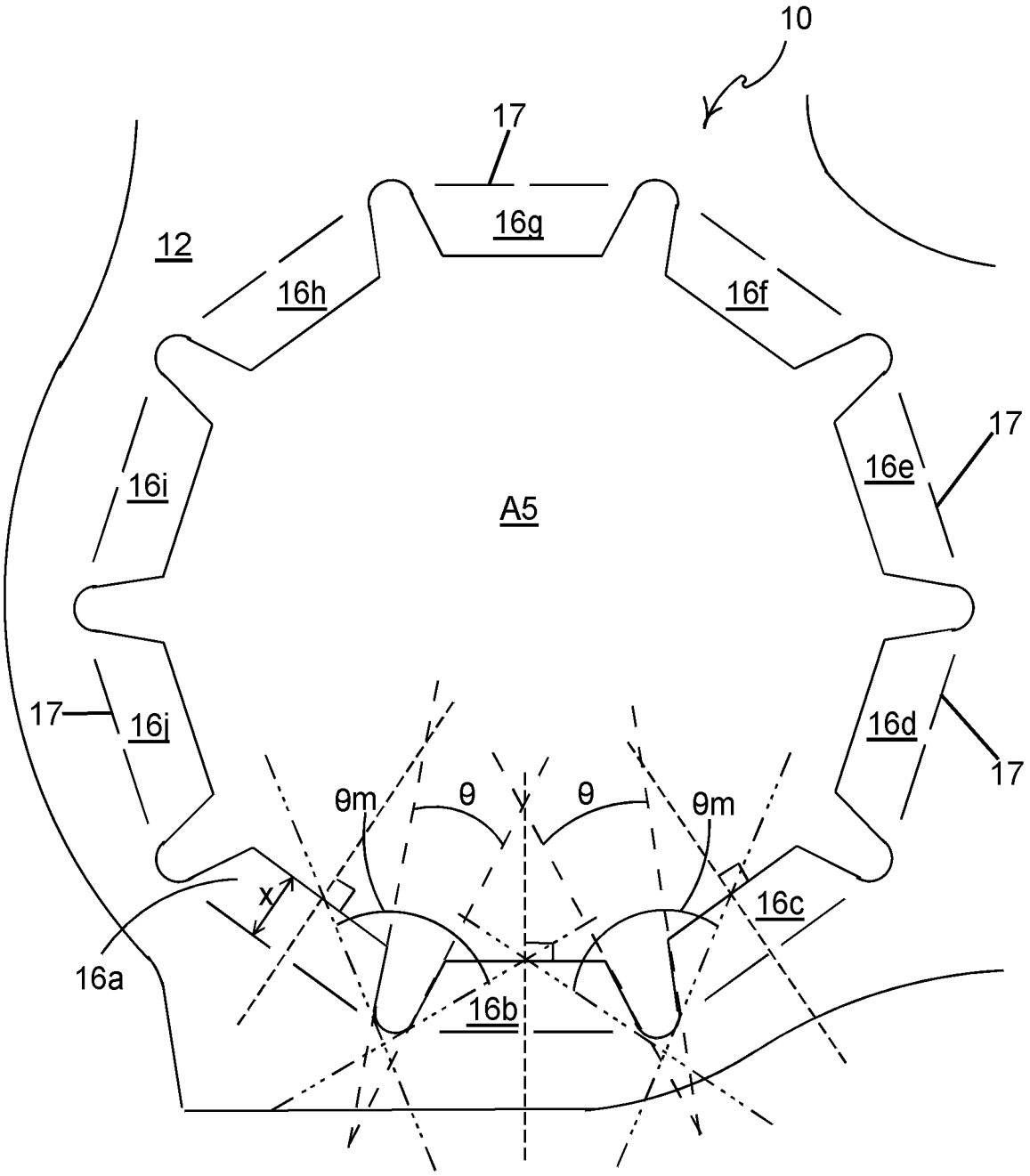
FIG. 2 is an enlarged plan view of the blank of FIG. 1.

The first side edge 19 of a first tab 16*c* and the second side edge 21 of a second tab 16*b* define an angle θ therebetween; that is to say, the convergent side edges 19, 21 of the trapezoidal portion of the cutaway 18 define the angle θ, see FIG. 2. The angle θ is greater than zero degrees and less than a maximum angle $\theta_m$. When the angle θ is equal to the angle $\theta_m$ the tabs 16 have a substantially triangular shape, thus reducing the engaging edge to a point.

The angle $\theta_m$ is defined by the following equation:

$$\theta_{max} = 2\left(\frac{180(N-2)}{2N} - \arctan\left(\frac{x}{\frac{Dn}{2}\sin\left(\frac{360}{2N}\right)}\right)\right)$$

where

N=number of sides of polygon P1 d=half the length of one side of the polygon P1 x=height of tab 16 and arctan denotes the inverse of the trigonometric function tangent

Figure 3:
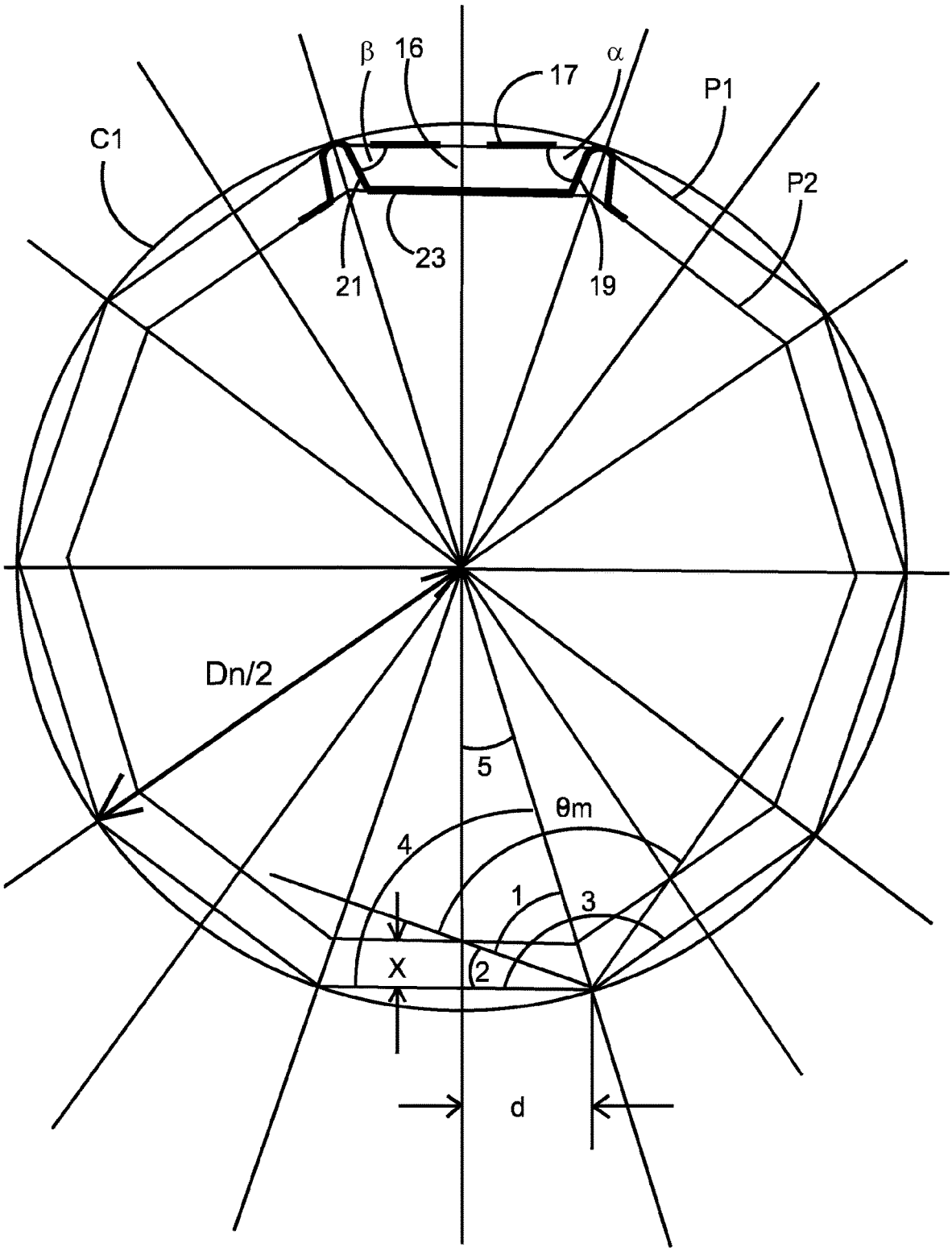
FIG. 3 is a schematic illustration of a retention structure of the blank of FIG. 1.

Referring to FIG. 3:

$$\theta_{max} = 2 \times \text{Angle 1}$$

$$\text{Angle 1} = \text{Angle 4} - \text{Angle 2}$$

$$\text{Angle 4} = \frac{\text{Angle 3}}{2}$$

$$\text{Angle 3} = \frac{180(N-2)}{N}$$

$$\text{Angle 2} = \arctan\left(\frac{x}{d}\right)$$

$$d = \frac{Dn}{2}\sin(\text{Angle 5})$$

$$\text{Angle 5} = \frac{360}{2N}$$

The diameter Dn of the notional circle C1, C2 must be at least equal to the diameter D2 of a chime, cap or flange 30 of the article B, see FIG. 5, in order that the upper end of the article B may pass through the main panel 12. Thus the diameter of the flange 30 defines a minimum dimension of the diameter Dn of the notional circle C1.

The diameter Dn of the notional circle C1, C2 must be less than equal to the maximum diameter D1 of the article B, in order that the entire article B cannot pass through the main panel 12. Thus the maximum diameter D1 of the article B (see FIG. 5, where the maximum diameter D1 is defined by a main body 34 of the article B) defines a maximum dimension of the diameter Dn of the notional circle C1. The main body 34 of the article B is connected to the chime 30 by a tapered or reducing diameter shoulder portion 32.

In some embodiments, diameter Dn of the notional circle C1 may be substantially equal to the diameter of a chime, cap or flange 30 of the article B, see FIG. 5.

The main panel 12 comprises a matrix or array of articles B in an Y×Z arrangement, where Y indicates the number of rows of articles B and Z indicates the number of columns of articles B. The width W of the main panel 12 may be equal to Z times the maximum width D1 of the article B; W=Z×D1. The length L of the main panel 12 may be equal to Y times the maximum width D1 of the article B; L=Y×D1.

In the embodiment illustrated in FIG. 1 the articles B are arranged in a 3×2 matrix. The width W of the main panel 12 may be equal to twice the maximum width D1 of the article B. The length L of the main panel 12 may be equal to thrice the maximum width D1 of the article B.

The diameter Dn of the notional circle C1 may be less than the maximum diameter D1 of an article B and greater than the diameter D2 of the chime, cap or flange of the article B.

In one example the article B may have a maximum diameter D1 of 2.6" (66 mm), the chime or flange 30 may have a diameter of 2.1" (53.3 mm) and the notional circle C1, C2 may have a diameter of 2.3" (58.4 mm). The tab 16 may have a height x of 3/16" (4.76 mm). The width W of the main panel 12 may be 5.3" (134.6 mm) and a length L of 7.8" (198.1 mm).

In another embodiment the angle θ is greater than 0° and less than 45°, in still another embodiment the angle θ is greater than 0° and less than 30°. The angle θ may be between 5° and 25°, or may be between 10° and 20°, or between 14° and 17°, or between 15° and 16°. In one embodiment the angle θ may be approximately 15.5°. In yet another embodiment the angle θ is greater than 0° and less than $$\frac{180(N-2)}{2N}$$

(where N=the number of sides of polygon P1).

Referring to FIG. 3 it can be seen that the hinged edge 17 of the tab 16 and the first side edge 19 define an angle α therebetween, and the hinged edge 17 of the tab 16 and the second side edge 21 define an angle β therebetween. The angle α may be less than or equal to $$\frac{180(N-2)}{2N}$$

(where N=the number of sides of polygon P1). The angle β may be less than or equal to $$\frac{180(N-2)}{2N}$$

(where N=the number of or sides of polygon P1).

In some embodiments, the maximum length L is equal to or less than Y×D1 when the main panel 12 is applied to articles B and the maximum width W is equal to or less than Z×D1 when the main panel 12 is applied to articles B.

Each tab 16 is hinged to the main panel 12 by a straight or linear fold line 17 which is in tangential contact, or intersects, with the rounded ends of the adjacent cutaways 18.

The curvilinear end 20 of each cutaway 18 may be defined in part by a circle having a radius of curvature. In one embodiment, the radius of curvature of the rounded end 20 of each cutaway 18 may be equal to or more than 1/16" (1.6 mm).

The main panel 12 may optionally comprise a handle structure. The handle structure may comprise a first handle aperture A7 and a second handle aperture A8. The first handle aperture A7 is struck from the main panel 12 and is located in a region disposed centrally between a first pair of article retention structures R1, R2 and a second pair of article retention structures R3, R4. The second handle aperture A8 is struck from the main panel 12 and is located in a region disposed centrally between the second pair of article retention structures R3, R4 and a third pair of article retention structures R5, R6. The first handle aperture A7 may be defined in part by a cushioning tab 14 hinged to the main panel 12 by a hinged connection such as a fold line 15. The second handle aperture A8 may be defined in part by a cushioning tab 14 hinged to the main panel 12 by fold line 15. Each of the first and second handle apertures A7, A8 may be substantially crescent or "C" shaped.

The main panel 12 may optionally comprise one or more pull tabs T1, T2, T3, T4. The pull tabs T1, T2, T3, T4 may be located substantially at the corners of the main panel 12. The pull tabs T1, T2, T3, T4 may be substantially triangular in shape. The pull tabs T1, T2, T3, T4 may be arranged to extend the main panel 12 beyond the footprint of the group of articles B being packaged; in this way a user may more readily disengage the carrier 90 from the articles B.

Optionally, the side edges 13*a*, 13*b* of the main panel 12 may be arranged in a curvilinear or undulating shape. In this way a first blank 10 may be arranged in a nested arrangement with a second blank 10, see FIG. 7. The undulating shape provides that the first and second blanks 10 together define a width which is less than twice the maximum width of an individual blank 10. This may have economic and environmental benefit by reducing the amount of substrate required to produce a given number of blanks 10.

The main panel 12 includes at least a paperboard substrate and a tear resistant layer laminated together. It optionally includes an adhesive layer between the paperboard substrate and the tear resistant layer. The material of the paperboard substrate may be selected from any conventional paperboard, for example, ranging in weight upwardly from about 10 pt., preferably from about 11 pt. to about 14 pt. An example of such a substrate is a 12-point SBS board or CNK board manufactured by WestRock Company. An example of a substrate that may be useful with the article carrier 10 shown in FIG. 1 is between about 24 pt. to about 32 pt. and optionally about 28 pt. The paperboard substrate may be a bleached or unbleached board. The board may be coated on at least one side, optionally the side opposite the lamination, with a conventional coating selected for compatibility with the printing method and board composition.

The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalyzed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low density polyethylene (LDPE). The adhesive layer may be placed between the substrate and the tear resistant layer to secure the tear resistant layer to the substrate.

Turning to the construction of the carrier 90 from the blank 10, the blank 10 may be applied to a group of articles B. The blank 10 is lowered with respect to the group of articles B. Each of the article retention structures R1, R2, R3, R4, R5, R6 of the blank 10 are aligned with a respective article B in the group. Portions of the articles B pass through the main panel 12. The tabs 16 of each of the article retention structures R1, R2, R3, R4, R5, R6 are folded out of the plane of the main panel 12 and engage beneath the chime or flange 30 of an article B. In this way the tabs 16 grip or hold the article B and prevent or inhibit the article B from unintentionally separating from the main panel 12. The assembled carrier 90 is shown in FIG. 6.

Referring in particular to FIG. 4 and to FIG. 1, the blank 10 forms a top engaging carrier 90 comprising a main panel 12 which comprises first and second adjacent apertures A1, A3 arranged side by side each for receiving a portion of an article B. The main panel 12 further comprises an annular series of tabs 16 formed around each of the first and second apertures A1, A3. The tabs 16 of each annular series are connected to the main panel 12 such that the tabs 16 yield out of the plane of the main panel 12 when an article B is received in the respective aperture A1, A3 so as to bear against the article B. The tabs 16 of each annular series are spaced apart from one another by a cutout 18 placed between each tab 16 and a next adjacent tab 16. Each cutout 18 has a rounded end 20 at a location furthermost from the center of the respective aperture A1, A3. Each annular series of tabs 16 defines a notional circle C1, C2 which is internally contacted tangentially by the rounded ends 20 of at least some of the cutouts 18, or optionally all of the respective cutouts 18. The notional circles C1, C2 of the two annular series of tabs 16 are spaced apart from each other at a first distance d2. The distance d1 between the rounded end 20 of any one of the cutouts 18 of the first aperture A1 and the rounded end 20 of any one of the cutouts 18 of the second aperture A3 is greater than the first distance d2.

Optionally, none of the tabs 16 have a radial size×greater than the radius Dn/2 of the respective notional circle C1, C2. In other words all of the tabs 16 have a radial size "x" less than the radius Dn/2 of the respective notional circle C1, C2.

Another optional feature of the carrier 90 is that the main panel 12 is defined by a perimeter to which no other part of the carrier 90 is connected, that is to say the carrier 90 is free of connection to other panels for example, but not limited to, side or end wall panels which extend about the sides of the article group. The perimeter of the main panel 12 is therefore defined in its entirety by free, cut or unhinged edges.

Another optional feature of the carrier 90 is that the main panel 12 is defined by a perimeter include convexly curved edges and concavely curved edges wherein the radius of curvature of the convexly curved edges is substantially equal to the radius of curvature of the concavely curved edges, thus allowing two similar blanks 10 to be placed in a nested or tessellated arrangement.

Referring now to FIG. 4, there is shown an additional embodiment of the present disclosure. In the second illustrated embodiment like numerals have, where possible, been used to denote like parts, albeit with the addition of the prefix "100" to indicate that these features belong to the second embodiment. The additional embodiment shares many common features with the first embodiment and therefore only the differences from the embodiment illustrated in FIGS. 1 to 3 and 5 to 7 will be described in detail.

The blank 110 comprises a plurality of main panels 112*a*, 112*b*, 112*c*, 112*d*, for forming top walls of a carrier. Each of the four main panels 112*a*, 112*b*, 112*c*, 112*d* illustrated in FIG. 4 is frangibly connected to its two adjacent neighbors by frangible connections 22, 24.

The blank 110 may be applied to twenty four articles arranged in a 6×4 matrix or array. In this way the blank 110 may be simultaneously applied to a plurality of groups of articles wherein each group comprises six articles arranged in 3×2 matrix or array.

In some embodiments the frangible connections are severed when the blank 110 is applied to the articles B. In some embodiments the articles B may be disposed within an open topped crate when the blank 110 is applied. In other embodiments the frangible connection may remain intact after the blank 110 is applied to the articles B and may be severed by an operative or end user so as to detach one or more of the main panels 112*a*, 112*b*, 112*c*, 112*d* and its associated article group from the rest.

Referring to FIG. 4 there is shown a plan view from above of a blank 110 that forms a set of top engaging clips 112*a*, 112*b*, 112*c*, 112*d* frangibly adjoined by frangible connections 22, 24. The blank 110 is to be attached as a single unit to a grouped arrangement of articles. Each top engaging clip 112*a*, 112*b*, 112*c*, 112*d* of the set is to be attached to an optional 2×3 arrangement of articles and separated from the other top engaging clips 112*a*, 112*b*, 112*c*, 112*d* to form four separate groups of arranged articles. Beneficially, in some arrangements, an apparatus automatically breaks the frangible connections 22, 24 between the top engaging clips 112*a*, 112*b*, 112*c*, 112*d* of the set of frangibly adjoined top engaging clips 112*a*, 112*b*, 112*c*, 112*d* such that the apparatus applies a single blank 110 to a grouped arrangement of articles and forms four smaller groups of articles each joined by a top engaging clip 112*a*, 112*b*, 112*c*, 112*d*.

In the illustrated embodiment, the blank 110 is configured to form a set of four clips 112*a*, 122*b*, 112*c*, 112*d* for grouping, coupling or otherwise linking together an exemplary arrangement of exemplary articles 'B'. In the embodiment illustrated in FIG. 3, each of the four clips 112*a*, 122*b*, 112*c*, 112*d* holds together, in a grouped arrangement, six articles arranged in three rows of two articles each. The articles 'B' are beverage cans having a rim or chimed upper edge. Accordingly the blank 110 is configured to be formed over a large grouped arrangement of articles 88. In the illustrated embodiment, the arrangement is a 6×4 matrix or array; in the illustrated embodiment four columns and six rows of articles are provided for a grouped arrangement 88 of twenty-four cans 'B'. In this illustrated embodiment, the blank 110 may employ four clips 112*a*, 112*b*, 112*c*, 112*d* in a 3×2 matrix or array, each being frangibly connected to at least two other blanks 112*b*, 112*c*, 112*d*, 112*a* by means of frangible connections 22, 24 and separating apertures A9. Alternatively, the blank 110 can be configured to form a carrier for packaging other types, number and size of articles and/or for packaging articles in a different arrangement or configuration to that shown herein.

Referring to FIG. 4, the blank 110 comprises four top engaging clips 112*a*, 112*b*, 112*c*, 112*d*, each having a main panel for forming a top wall or engaging panel of the clip 112*a*, 112*b*, 112*c*, 112*d*.

Each main panel includes at least one article retention structure. In the embodiment of FIG. 4 each main panel comprises a plurality of article retention structures, specifically six article retention structures arranged in 2×3 matrix or array.

The main panels 112*a*, 112*b*, 112*c*, 112*d* each comprise a matrix or array of article retention apertures, in a Y×Z arrangement, where Y indicates the number of rows of articles 'B' and Z indicates the number of columns of articles 'B'.

In the embodiment illustrated in FIG. 4 the articles 'B' are arranged in a 3×2 matrix. The width of the main panel 112*a*, 112*b*, 112*c*, 112*d* may be equal to twice the maximum width of the article 'B'. The length L of the main panel 112*a*, 112*b*, 112*c*, 112*d* may be equal to thrice (three times) the maximum width of the article B'.

The diameter of the notional circle may be less than the maximum diameter of an article 'B' and greater than the (smaller) diameter of the chime, cap or flange of the article B'.

The main panels 112*a*, 112*b*, 112*c*, 112*d* may optionally comprise a handle structure. The handle structure may comprise a first handle aperture and a second handle aperture. The first handle aperture is struck from the main panel 112*a*, 112*b*, 112*c*, 112*d* and is located in a region disposed centrally between four article retention structures. The second handle aperture is struck from the main panel 112*a*, 112*b*, 112*c*, 112*d* and is located in a region disposed centrally between four article retention structures. The first handle aperture may be defined in part by a cushioning tab hinged to the main panel 112*a*, 112*b*, 112*c*, 112*d* by a fold line. The second handle aperture may be of similar construction.

The main panels 112*a*, 112*b*, 112*c*, 112*d* may optionally comprise one or more pull tabs T1. The pull tabs T1 may be located substantially at the corners of the main panel 112*a*, 112*b*, 112*c*, 112*d*. The pull tabs T1 may be substantially triangular in shape. The pull tabs T1 may be arranged to extend the main panel 112*a*, 112*b*, 112*c*, 112*d* beyond the footprint of the group of articles being packaged; in this way a user may more readily disengage the carrier or clip 112*a*, 112*b*, 112*c*, 112*d* from a group of articles.

Another optional feature of the top engaging clips 112*a*, 112*b*, 112*c*, 112*d* is that the main panels 112*a*, 112*b*, 112*c*, 112*d* are each defined by a perimeter to which no other part of the top engaging clip 112*a*, 112*b*, 112*c*, 112*d* is connected. That is to say the top engaging clip 112*a*, 112*b*, 112*c*, 112*d* is free of connection to other panels for example, but not limited to, side or end wall panels which in other carriers extend about the sides of the article group. The perimeter of the main panel 112*a*, 112*b*, 112*c*, 112*d* is therefore defined in its entirety by free, cut or unhinged edges. The perimeter of the main panel 112*a*, 112*b*, 112*c*, 112*d* may be folded at an angle relative to the rest of the main panel, by virtue of the folding of the polygonal arrangement of tabs of the article retention structures and their engagement beneath the chime or flange of an article B'. Accordingly, the frangible connections 22, 24 are broken and the set of frangibly adjoined top engaging clips 110 is automatically broken into four separate top engaging clips 112*a*, 112*b*, 112*c*, 112*d* thus forming four separate groups of articles.

It will be recognized that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cut line, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carrier, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. An article carrier comprising a main panel which comprises at least two article retention structures, each having an aperture formed through the main panel, and further comprising one or more tabs formed about a periphery of the aperture in the main panel, the one or more tabs being connected to the main panel such that the tabs yield out of the plane of the main panel so as to bear against an article received in the aperture, wherein the main panel comprises a paperboard substrate and at least one polymeric layer, and wherein the main panel is so dimensioned as to have a maximum length equal to or less than a product of a maximum diameter D1 of articles that the article carrier is configured to receive in the aperture in the main panel and a first integer number of rows Y of an array in which the at least two article retention structures are arranged.

2. The article carrier according to claim 1 wherein the at least one polymeric layer comprises an n-axially oriented film wherein "n" is a positive integer.

3. The article carrier according to claim 2 wherein the n-axially oriented film is formed from material selected from the group consisting of a bi-axially oriented polyester, oriented nylon, cross-laminated polyolefin, metallocene-catalyzed polyethylene and high density polyolefin.

4. The article carrier according to claim 1 wherein the at least one polymeric layer is tear resistant due to the chemical nature of the material from which it is formed.

5. The article carrier according to claim 4 wherein the material is extruded metallocene-catalyzed polyethylene.

6. The article carrier according to claim 1 wherein the main panel is defined by a perimeter to which no other part of the carrier is connected.

7. The article carrier according to claim 1 wherein the array has a second integer number of columns Z, and wherein the main panel has a maximum width equal to or less than Z×D1 when the main panel is applied to articles.

8. The article carrier according to claim 1 wherein the main panel has opposite surfaces having different characteristics to the other surface.

9. The article carrier according to claim 8 wherein one of the opposite surfaces has a surface treatment to provide good printability.

10. The article carrier according to claim 9 wherein the polymeric layer is provided on the other surface of the main panel.

11. The article carrier according to claim 1 wherein the polymeric layer is a tear resistant layer applied to an uncoated side of the paperboard substrate and laminated with the paperboard substrate.

12. The article carrier according to claim 1 wherein the main panel comprises a handle structure.

13. The article carrier according to claim 12 wherein the handle structure comprises at least one handle aperture formed in the main panel at location spaced from the aperture.

14. A blank for forming an article carrier, the blank comprising a main panel which comprises at least one article retention structure having an aperture defined through the main panel, the main panel being the only panel with an aperture configured to have an upper portion of an article received therethrough, the main panel further comprising one or more tabs formed about a periphery of the aperture in the main panel, the one or more tabs being connected to the main panel such that the tabs yield out of the plane of the main panel when the article is received in the aperture so as to bear against the article in an article-carrying configuration in which the main panel is applied to one or more articles, wherein the main panel comprises a paperboard substrate, and wherein the main panel has a maximum length equal to or less than Y×D1 in the article-carrying configuration, where D1 is a maximum diameter of the one or more articles, and Y is a first integer number of rows of an array in which the at least one article retention structure is arranged.

15. The blank according to claim 14 wherein the paperboard substrate is formed from foldable sheet material selected from the group consisting of paperboard, corrugated board, cardboard and combinations thereof.

16. The blank according to claim 14 wherein the main panel is defined by a perimeter including convexly curved edges and concavely curved edges wherein the radius of curvature of the convexly curved edges is substantially equal to the radius of curvature of the concavely curved edges.

17. The blank according to claim 14 wherein the array has a second integer number of columns Z, and wherein the main panel has a maximum width equal to or less than Z×D1 when the main panel is applied to articles.

18. The blank according to claim 14, wherein the main panel comprises a single panel in a direction of thickness.

19. A blank for forming article carriers, the blank comprising a main panel and at least one additional main panel, each main panel comprising at least one article retention structure having an aperture defined in each main panel, wherein each main panel further comprises one or more tabs formed about a periphery of the aperture in each main panel, the one or more tabs being connected to each main panel such that the one or more tabs yield out of the plane of each main panel when each main panel is applied to at least one article such that the at least one article is received in the aperture so as to be supported by the one or more tabs, wherein each main panel comprises a paperboard substrate, wherein the main panel and the at least one additional main panel comprises a first main panel and a second main panel adjacent the first main panel, wherein the first main panel comprises a first aperture and a second aperture adjacent the first aperture, wherein the second main panel comprises a third aperture adjacent the first aperture, wherein a distance between a notional center of the first aperture and a notional center of the second aperture is substantially equal to a distance between the notional center of the first aperture and a notional center of the third aperture.

20. The blank according to claim 19, wherein the main panel and the at least one additional main panel are connected to each other by a frangible connection such that the main panels are separable from each other when applied substantially simultaneously to a plurality of articles.

21. The blank according to claim 19, wherein each main panel is arranged to be applied to articles having a maximum diameter D1 in an array having a first integer number of rows Y, wherein each main panel has a first length substantially equal to Y×D1 in a first configuration and wherein each main panel has a second length that is less than the first length in an article-carrying configuration in which each main panel is applied to one or more articles.

* * * * *